US007245738B2

(12) United States Patent
Pribyl

(10) Patent No.: US 7,245,738 B2
(45) Date of Patent: Jul. 17, 2007

(54) ELECTROACOUSTIC TRANSDUCER WITH SMALL DIMENSIONS

(75) Inventor: Richard Pribyl, Fischamend (AT)

(73) Assignee: AKG Acoustics GmbH, Vienna (AT)

( * ) Notice: Subject to any disclaimer, the term of this patent is extended or adjusted under 35 U.S.C. 154(b) by 46 days.

(21) Appl. No.: 10/678,453

(22) Filed: Oct. 2, 2003

(65) Prior Publication Data

US 2004/0066950 A1 Apr. 8, 2004

Related U.S. Application Data

(62) Division of application No. 09/852,444, filed on May 9, 2001, now Pat. No. 6,668,066.

(30) Foreign Application Priority Data

May 15, 2000 (AT) ..... 842/2000

(51) Int. Cl.
*H04R 25/00* (2006.01)

(52) U.S. Cl. ..... 381/396; 381/171; 381/430

(58) Field of Classification Search ..... 381/396, 381/398, 400, 412, 419, 433, 171, 430
See application file for complete search history.

(56) References Cited

U.S. PATENT DOCUMENTS 6,151,402 A * 11/2000 Azima et al. ..... 381/396
6,537,234 B1 * 3/2003 Komatsu ..... 381/396

* cited by examiner

*Primary Examiner*—Suhan Ni
(74) *Attorney, Agent, or Firm*—Friedrich Kueffner

(57) ABSTRACT

An electroacoustic transducer of small dimensions has a cup-shaped component made of a metallizable plastic material embedded in a housing component having a housing shape and being of a non-metallizable plastic material. The cup-shaped component has an inner surface provided with a metal coating. A magnet is arranged in the cup-shaped component. A diaphragm is connected to the housing component and has an oscillation coil configured to interact with the magnet.

3 Claims, 4 Drawing Sheets

FIG. 5
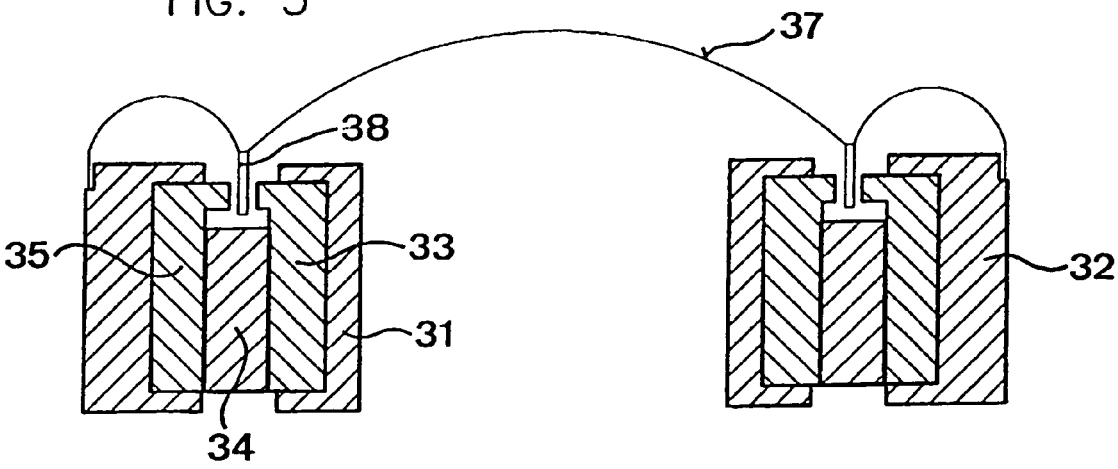
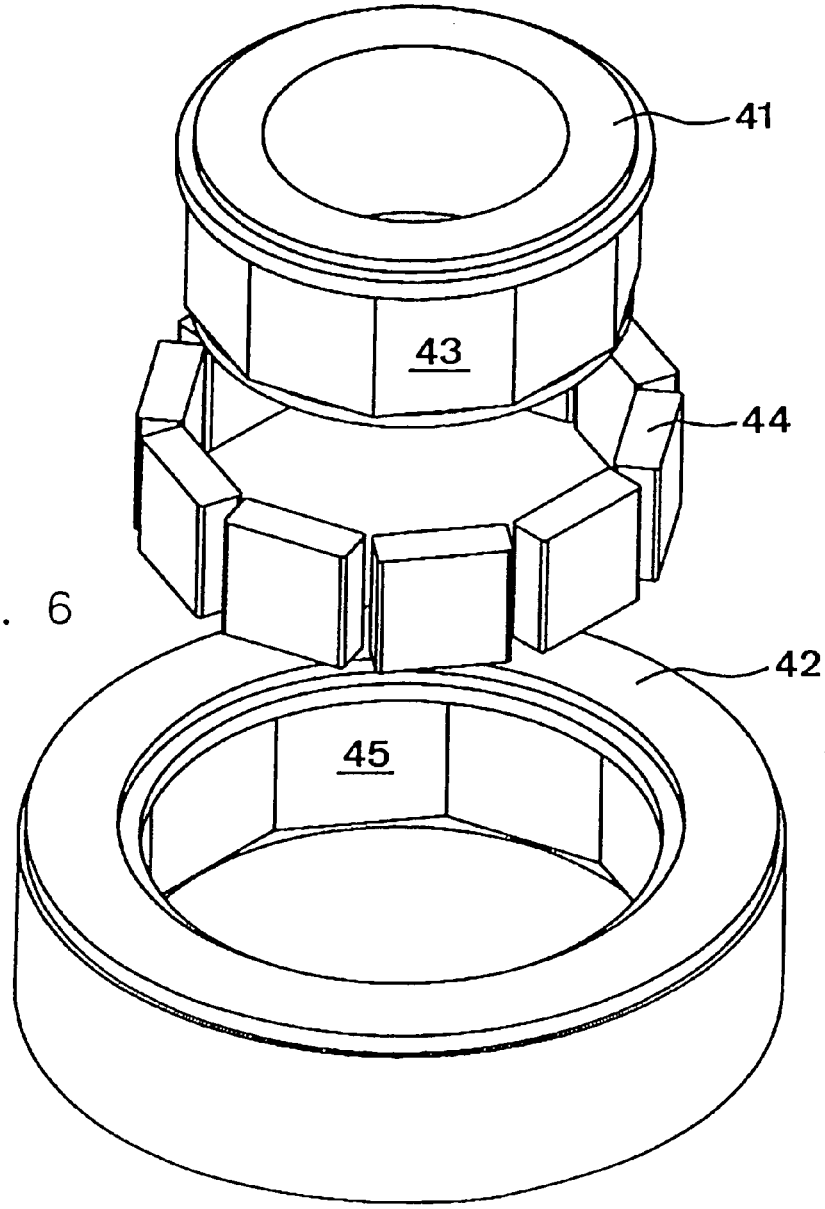
FIG. 6

ELECTROACOUSTIC TRANSDUCER WITH SMALL DIMENSIONS

This application is a divisional application of U.S. application Ser. No. 09/852,444 filed May 9, 2001, now U.S. Pat. No. 6,668,066.

BACKGROUND OF THE INVENTION

1. Field of the Invention

The invention relates to an electroacoustic transducer with small dimensions, in particular, transducers having a housing with an outer diameter of 15 mm or less.

2. Description of the Related Art

With increasing miniaturization of electroacoustic transducers for use in cordless telephones, cellular telephones, head sets, dictation devices, computer monitors etc., there are problems which are unknown in classic transducer technology. An important problem is trying to maintain the transducer characteristics in view of the relative tolerances which, as a result of the reduction of the dimensions, become increasingly greater while at the same time trying to keep constant or even reduce the cost per piece, because, as a result of the high production numbers, the question of cost is of much greater significance than in the case of large-volume transducers which are produced in small production numbers for special applications.

Classic electroacoustic transducers which operate according to the electro-dynamic principle are comprised essentially of a cup-shaped housing which is open at the front and into which a magnetic system is introduced from the front. The magnetic system is comprised of the actual magnet and a multi-part yoke wherein the yoke forms at the front side an annular air gap. A diaphragm, which is fastened on the housing at the front side of the magnetic system, has a oscillation coil which projects into the air gap of the yoke and can oscillate in this air gap in the axial direction. The individual yoke parts are usually the following: a cup-shaped part arranged at the bottom, having the magnet glued thereto at its center, and a circular front part whose outer circumference forms the inner circumference of the air gap.

The special problem of the miniaturization is the centricity or eccentricity between the air gap and the oscillation coil because, when any eccentricity is present, the diaphragm begins to wobble and the transducer characteristics are significantly disturbed. In the case of miniaturization of the transducer, the eccentricities, which for large-size transducers are still permissible, present a serious quality problem because the relative eccentricity for the same absolute tolerances and miniaturization of the components increases, of course, with the degree of miniaturization. For example, in the case of transducers with a diameter of the housing of approximately 15 mm it is already required to lower the eccentricity into the range of less than hundredths of millimeters in order to achieve the predetermined transducer characteristics without distortion.

When it is also taken into consideration that the tolerances of the usually employed parts, i.e., housing, magnetic system, securing rings and the like, in the normal transducer construction are in the range of tenths of millimeters, while in the case of highly precise parts as they are mandatorily required for the small transducers the tolerances are in the range of five hundredths of millimeters, it is immediately clear that even for average pairs of tolerances eccentricities can occur easily which are no longer within acceptable limits. In the case of unfavorable pairs, the permissible eccentricity is easily surpassed.

SUMMARY OF THE INVENTION

It is an object of the present invention to solve these problems and to provide a transducer of small dimensions, in particular, with an outer diameter of the housing of 15 mm or less which achieves the required precision and, in particular, the required centricity in an inexpensive way.

In accordance with the present invention, this is achieved in that the electroacoustic transducer is comprised of a cup-shaped component having at least one radial projection of a metallizable plastic material which is embedded in a component having a housing shape and being of a plastic material which cannot be metallized and that the inner surface of the cup-shaped component and at least one portion of the surface of the radial projection is provided with a metal coating.

A method according to the invention for producing such an electroacoustic transducer is characterized in that a component with the shape of the magnet cup, including the contacts of the electroacoustic transducer, is produced by injection molding of a plastic material that can be metallized, in that subsequently in the same injection molding tool, but by using a different top part of the injection mold, this component is embedded in a plastic material forming a housing shape which plastic material cannot be metallized, and in that the surface areas forming the magnet cup and the contacts, are provided with a metal coating. The latter can be realized, for example, by chemical activation, subsequent copper coating, followed by coating with nickel.

With the inventive measures a single-part body is obtained which is a monolithic part comprising the conventional magnet cup as well as the housing and also the contacts because these parts are formed and produced in a single mold which prevents the tolerances, which are unavoidable according to the method of the prior art, and thus also their summation and interaction.

The method according to the invention is especially suitable for electroacoustic transducers of minimal size because only for such miniaturized transducers the obtainable metallic cross-sections obtainable by the copper coating and nickel coating are sufficient in order to be useful as conductors.

BRIEF DESCRIPTION OF THE DRAWING

In the drawing:

FIG. 5 shows a transducer with radial magnet according to the prior art; and FIG. 6 shows a transducer according to the invention with radial magnet.

DESCRIPTION OF THE PREFERRED EMBODIMENTS

Figure 1:
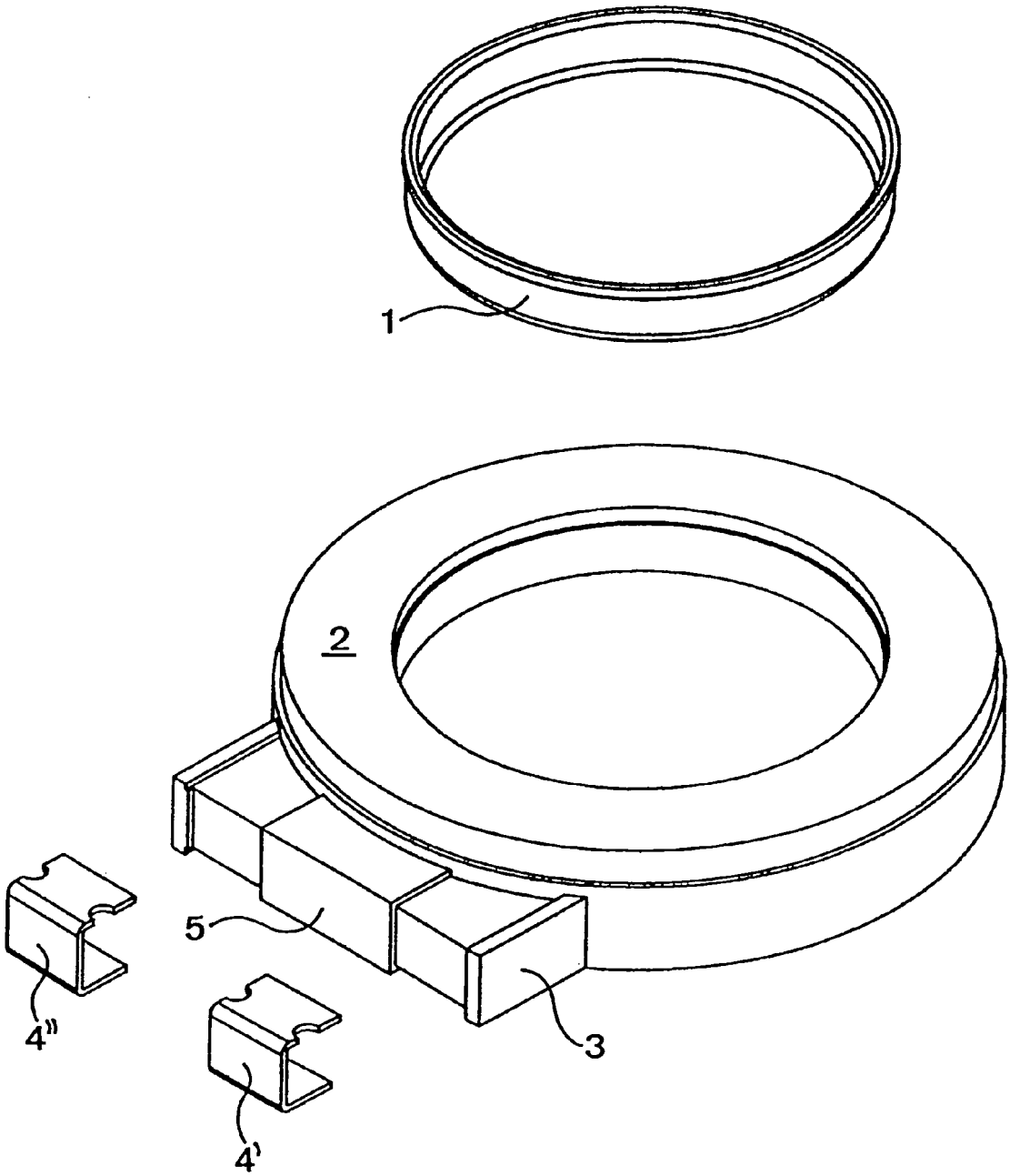
FIG. 1 shows the configuration of an electroacoustic transducer according to the prior art in a purely schematic illustration before assembly.

FIG. 1 shows those parts of a prior art electroacoustic transducer that are essential for understanding the invention. Illustrated are the lower cup-shaped yoke part 1 which is conventionally produced of soft iron sheet metal by deep drawing. This method produces an inner diameter that is sufficiently precise; the outer diameter, on the other hand, depends on the sheet metal thickness, the sheet metal quality, and its ductility and is thus prone to have tolerance variations. When mounting the cup-shaped yoke part 1 in the housing 2 produced by injection molding, joint gaps and, as a result of this, eccentricities are caused. When, in order to prevent such joint gaps, overlapping tolerances are selected, deformations result and inner mechanical stresses are generated which are released, in particular, when temperature loading occurs, and cause deformation of the sensitive diaphragm (not illustrated) at the upper housing part, and this, in turn, results in acoustic distortions and wobbling of the diaphragm when it is oscillating.

Conventionally, two contacts 4 for the supply wires of the oscillation coil (not illustrated) of the diaphragm are arranged on a projection 3 of the housing 2. These contacts 4 are conventionally made of sheet metal as stamped or bent parts which are to be mounted precisely and fixedly on the projection 3. These parts must therefore be attached by gluing, for which purpose a drop of adhesive of a volume of approximately 0.3 $mm^3$ is to be used. This dosage and correct placement present great problems for an automated series production and require monitoring and attendance by an operator. Also, the manufacture and the handling of the contacts themselves, since their maximum dimensions for their original size are in the range of approximately 1.5 mm, are very difficult.

Figure 2:
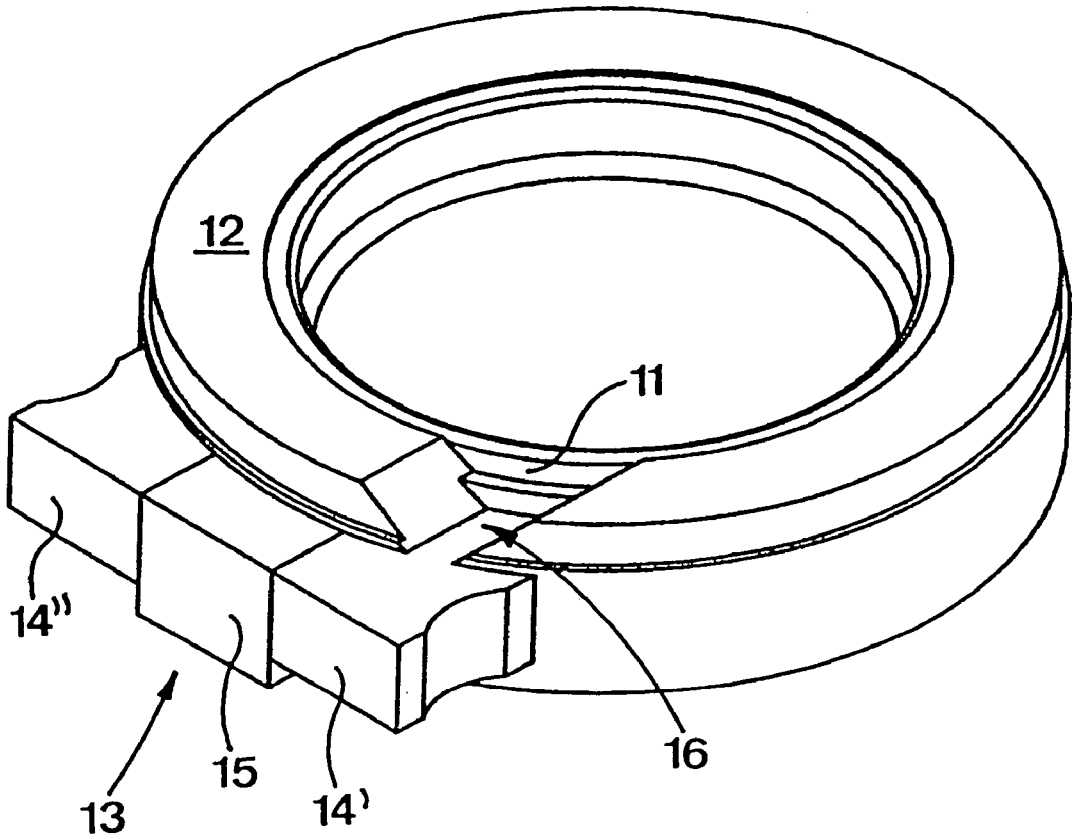
FIG. 2 shows an electroacoustic transducers according to the invention in a schematic view.

These problems are completely avoided by the measures according to the invention. According to the invention, a component 11 is produced in an injection mold which has substantially the shape of the cup-shaped yoke part 1 on which, however, the projection 13, corresponding to the projection 3, is formed as a monolithic part. This component 11 is comprised of plastic material that can be metallized and, once it is solidified in the injection mold, is not removed therefrom but instead only the top part of the injection mold is replaced by a different top part. Subsequently, this cup-shaped component 11 is then embedded at important areas by a plastic material which cannot be metallized and in the final state has an outer shape which matches, at least mostly, the shape of the housing 2 of conventional electroacoustic transducers. This outer part 12 has preferably at one location, as illustrated in FIG. 2, a cutout or notch 16 so that the area 14' of the projection 13 is connected by a free surface in the area of the notch 16 with the inner area of the cup-shaped component 11.

Between the contact part 14' and its corresponding part 14" a cover 15 is provided by which the surface of the projection 13 is divided into two areas that can be metallized which have between them no connection that could be metallized. Accordingly, the two contacts are electrically separated from one another. The material of the housing part 12 completely surrounds the outer side (the underside which is not visible in FIG. 2) of the cup-shaped component 11 entirely.

When now the surfaces to be metallized are treated to be metallized, after corresponding activation of the plastic material in a bath, it is possible to use the future contacts 14', 14" at the same time also for metallizing the inner side of the cup-shaped component 11 and the outer portion of its mantle of the small surface area that is being exposed in the area of the notch 16, this being achieved in the illustrated example by the contact 14' and the notch 16.

This metallization which includes, for example, the application of a copper layer and the subsequent application of a nickel layer by electroplating processes, belongs to the prior art and therefore requires no detailed explanation. It should only be mentioned that, for forming a functional coating, the layer thickness of the nickel layer must be at least 25 μm and is preferably at least 100 μm.

The further processing of the thus produced semi-finished electroacoustic transducer is carried out in a conventional way: The magnet, together with the disk-shaped yoke part already glued thereto, is glued onto the center of the cup-shaped component 11, wherein by means of corresponding guides and templates a sufficient centricity is ensured. Subsequently, the diaphragm is fastened on the housing part 12, optionally by means of a mounting or securing ring, so that the oscillation coil mounted on the diaphragm is centrally positioned in the air gap. The supply wires of the oscillation coil are guided out of the interior of the closed transducer in the area of the diaphragm attachment and are mechanically and electrically connected with one of the two contacts 14', 14", respectively, for example, by friction welding or ultrasound welding.

The outer sides or the undersides of the two contacts 14', 14" serve for contacting the electroacoustic transducer in the device in which it is used.

Since the diaphragm, the coil connected thereto, and the securing ring of the diaphragm are produced in a single working step, their centricity is ensured to a high degree. Since the securing ring is fastened on the housing part 12 and this part is positioned with excellent centricity relative to the cup-shaped part 11, the problem of eccentric arrangement of the oscillation coil in the air gap is solved in the best possible way. With the one-part configuration of the cup-shaped component 11 and of the housing part 12 and also with the contacts 14', 14", the entire handling for such a highly miniaturized electroacoustic transducer is extraordinarily improved in comparison to handling according to the prior art.

Figure 3:
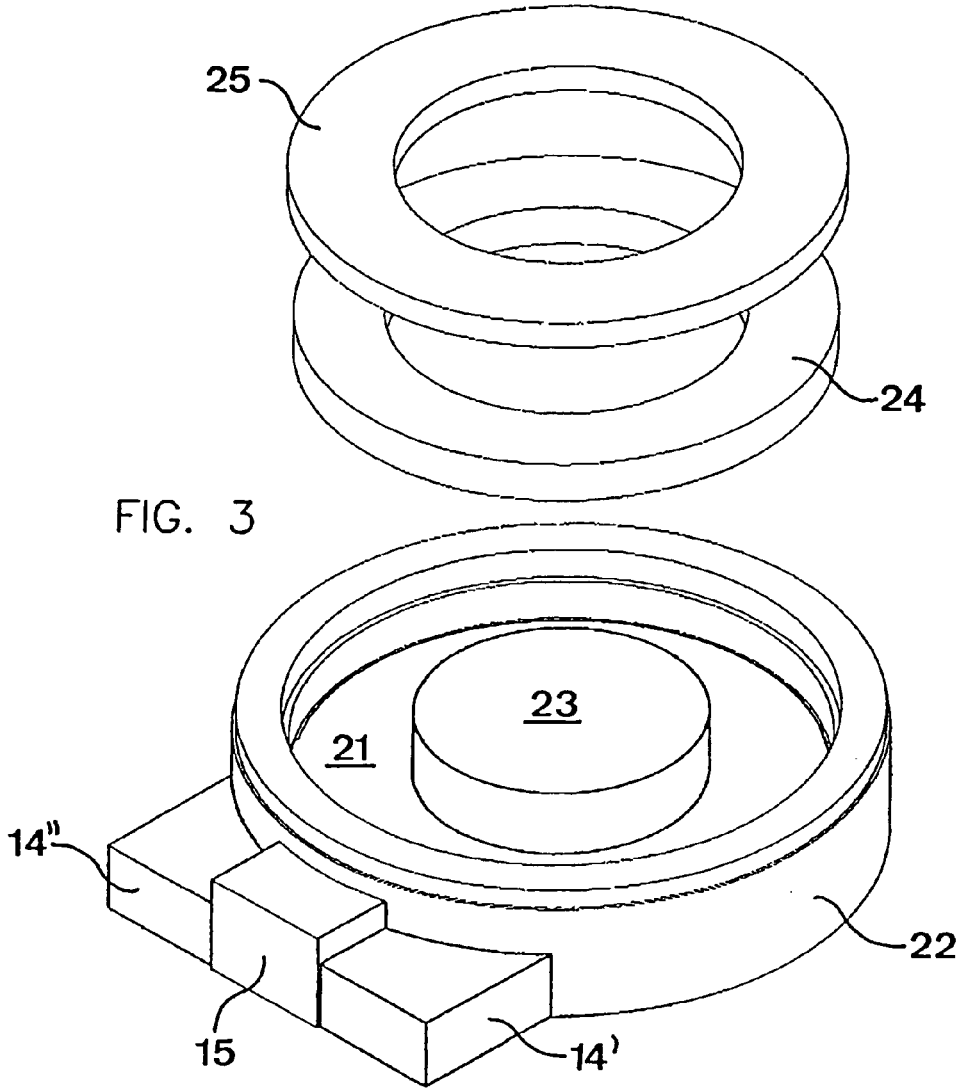
FIG. 3 shows a variant of the electroacoustic transducer according to the invention in an exploded view.
Figure 4:
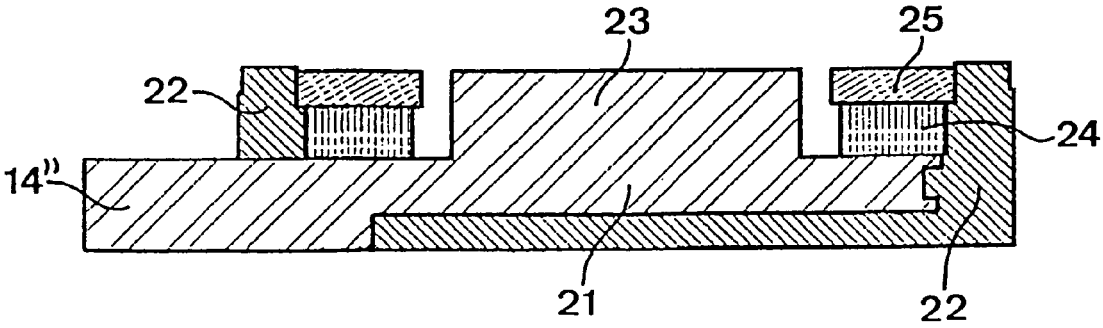
FIG. 4 shows the variant of the electroacoustic transducer of FIG. 3 in the assembled state in section.

FIGS. 3 and 4 show a variant of the measures according to the invention with a somewhat different configuration of the transducer as compared to the one obtainable according to FIG. 2. As illustrated in the exploded view pulled apart in the axial direction, a body part 21 with correspondingly partially electroplated surface is embedded in a housing part 22 wherein the material of the housing part 22 cannot be electroplated. The body part 21 has a monolithic central projection which represents the inner yoke part 23.

Into the annular gap thus formed between the inner yoke part 23 and the housing part 22 an annular magnet 24, which is magnetized in the axial direction, is inserted and above it an also annularly shaped pole plate 25 is inserted and glued to the body part 21 and the housing part 22.

As a result of the manufacture in a single mold with use of an exchangeable top part, the best possible precision and the prevention of any type of summation of tolerances are achieved so that the insertion of the pole plate 25 into the corresponding cutouts of the housing part 22 does not contribute to the eccentricity that is to be expected otherwise.

In the FIGS. 3 and 4, in deviation from the embodiment in FIG. 2, the contacting is not illustrated, but it can be realized analogously as shown therein or in a different way.

The insertion of the pole plate 25 must not be carried out as illustrated in FIG. 4 because it may be actually advantageous to configure the recess in the housing part 22 in the axial direction so large that the pole plate in the axial direction is seated exclusively on the annular magnet 24 and is glued thereto, wherein the cutout in the housing part 22 only provides a radial guiding action.

A further variant is illustrated in FIGS. 5 and 6. One or several correspondingly arranged radially magnetized magnets are used in this embodiment. FIG. 5 shows the conventional configuration of such electroacoustic transducers according to the prior art, while FIG. 6 shows a variant according to the invention.

As can be seen in FIG. 5, an electroacoustic transducer with radially magnetized magnet comprises several plate-shaped magnets which are magnetized in a direction perpendicular to the major plane of the plates wherein these plates are arranged along the mantle surface of a regular polygon. The reason for using such an arrangement is that it is extremely difficult to produce annular magnets with radial magnetization so that the illustrated quasi-annular arrangement is used instead.

As can be seen in FIG. 5, radially within and radially outside of the individual magnet plates a yoke part is arranged, respectively, thus an inner yoke part 33 and an outer yoke part 35 are formed. These two yoke parts have at the front side of the electroacoustic transducer, facing a diaphragm 37 illustrated in FIG. 5, an air gap between them, wherein the oscillation coil 38 is positioned in this air gap. The two yoke parts are supported in an inner housing 31 and an outer housing 32, respectively, wherein the outer housing 32 also supports the diaphragm 37.

In the embodiment according to the prior art, as illustrated in FIG. 5, it is necessary to machine the two metallic yoke parts 33, 35 by a cutting machining process, i.e., by milling, because there is no other way of providing an areal contact between the individual magnets 34 and the facing sides of the yoke parts 33, 35. During their manufacture, the yoke parts together with their plastic housings are secured in a centering device and the magnets 34 are then inserted into the hollow spaces provided for them and are glued to the yoke parts. After curing of the adhesive, the transducer is removed from the centering device for mounting the diaphragm 37 and is then further assembled.

The invention now makes it possible to simplify these complicated working steps drastically and to thus make available the magnet arrangement, which is favorable for certain applications, to a wider field of use because the thus configured transducers are no longer subject to the previous high manufacturing costs. The transducer according to the invention of this kind is illustrated in FIG. 6. A partially electroplated metallized outer housing 42 and an at least partially galvanized yoke part 41 are provided during the injection molding process with corresponding planar surfaces 43, 45 between which in the assembled state the plate-shaped magnets 44 will be positioned. The surfaces 43, 45 and the adjacent areas (in the upward direction in FIG. 6), which between them leave the air gap, are electroplated with metal and serve as the yoke for the magnetic system. It is possible, in order to achieve a coating which covers only a part of the surface, to produce the yoke part 41 and the housing part 42 of two different plastic material types in a two-step injection molding process as has been discussed in the description of the variant illustrated in FIG. 2.

For centering it is possible, for example, to insert the two parts 41, 42 head first into a centering ring which matches the air gap to be formed and to subsequently thread the individual magnet plates 44 into the resulting pockets from the bottom side which is now facing upwardly and to glue them into place.

In FIG. 6 a central-symmetric transducer body is represented but it is, of course, also possible and may be advantageous to form the contacts, as illustrated in the embodiment of FIGS. 2 and 3, at the same time and to also electroplate them, which can be carried out in analogy to the embodiment of FIGS. 2 or 3 and does not require any further explanation.

In FIG. 6, an annular groove is indicated at the upper edge of the housing part 42 which groove is configured to receive a securing ring for a diaphragm. This annular groove can, of course, also be of a different configuration. The attachment of the diaphragm on the housing part belongs to the prior art. As a result of the integral manufacture by injection molding, an extremely high centricity can be achieved without this causing the otherwise incurred expenses.

The invention is not limited to the illustrated embodiments but can also be varied in many ways. It is essential that at least a portion of the parts of the magnet system forming the yoke of an electroacoustic transducer is not formed as discrete components but provided as a metallic coating on a plastic part of the electroacoustic transducer produced by injection molding. It is particularly preferred that all yoke parts are comprised of such metallic coatings because in this way the best-possible centering can be achieved in the simplest and economically most feasible way.

In an advantageous embodiment of the invention, it is proposed to produce the contacts for contacting of the electroacoustic transducer also in this way and to thus avoid the separate manufacture and the subsequent application of metallic contacts.

In both applications it is possible to select, instead of the described application of the copper coating and subsequent application of nickel, a different metallic coating, the only requirement being that, when it is used for the yoke parts, it has the required magnetic properties. This is, in particular, the case when technical pure iron or cobalt is used. For producing the contacts for contacting the electroacoustic transducer it is, of course, also possible to use gold or apply thicker copper layers. A corresponding multi-step treatment or a separate electroplating treatment of the yoke parts and of the contacts is then required but does not play a critical role as a result of the uncritical manipulation of the already finished injection-molded transducer body.

While specific embodiments of the invention have been shown and described in detail to illustrate the inventive principles, it will be understood that the invention may be embodied otherwise without departing from such principles.

What is claimed is:

1. An electroacoustic transducer of small dimensions, comprising:

a yoke part having an outer mantle surface, wherein the outer mantle surface is metallized;

an annular housing component separate from the yoke part and having an inner mantle surface, wherein the inner mantle surface is metallized;

radially magnetized magnet plates arranged between the metallized inner mantle surfaces and the metallized outer mantle surface;

a diaphragm connected to the housing component and having an oscillation coil configured to interact with the magnet plates.

2. The electroacoustic transducer according to claim 1, wherein the yoke part has at least one radial projection and at least a part of a surface of the radial projection is provided with a metal coating.

3. The electroacoustic transducer according to claim 1, wherein the housing component has an outer diameter of 15 mm or less.

* * * * *